US006684756B2

(12) United States Patent
Kerr

(10) Patent No.: US 6,684,756 B2
(45) Date of Patent: Feb. 3, 2004

(54) TEA INFUSER WITH MANUAL AGITATOR

(75) Inventor: Helen Kerr, Toronto (CA)

(73) Assignee: Browne & Co. Ltd. (CA)

( * ) Notice: Subject to any disclaimer, the term of this patent is extended or adjusted under 35 U.S.C. 154(b) by 43 days.

(21) Appl. No.: 10/004,592

(22) Filed: Dec. 4, 2001

(65) Prior Publication Data

US 2003/0101873 A1 Jun. 5, 2003

(51) Int. Cl.[7] ..... A47J 31/00
(52) U.S. Cl. ..... 99/297; 99/287
(58) Field of Search ..... 99/287, 297, 323

(56) References Cited

U.S. PATENT DOCUMENTS 417,168 A * 12/1889 Giles ..... 99/287
618,089 A * 1/1899 Haslam ..... 99/323
2,808,775 A * 10/1957 Schott ..... 99/297
2,893,331 A * 7/1959 Medlock ..... 99/297
3,339,476 A * 9/1967 Troya ..... 99/287
5,635,233 A * 6/1997 Levinson ..... 99/287

* cited by examiner

*Primary Examiner*—Reginald L. Alexander
(74) *Attorney, Agent, or Firm*—Mark Kusner; Michael A. Jaffe

(57) ABSTRACT

An infuser vessel (1) for containing solid particles (2) while immersed in a liquid, such as loose tea leaves in hot water, where the perforated infuser vessel (1) includes a manually movable piston (7) operated with a flexible wire (11) topped with a manual grip (12) extending upwardly from the liquid, whereby tea leaves (2) within the vessel (1) may be manually agitated to increase the speed and efficacy of infusion, while the manual grip (12) remains high and dry above the liquid.

9 Claims, 3 Drawing Sheets

TEA INFUSER WITH MANUAL AGITATOR

TECHNICAL FIELD

The invention relates to an infuser for containing solid particles while immersed in a liquid, such as loose tea leaves in hot water, where the perforated infuser vessel includes a manually movable piston operated with a flexible wire topped with a manual grip extending upwardly from the liquid, whereby tea leaves within the vessel may be manually agitated to increase the speed and efficacy of infusion, while the manual grip remains high and dry.

BACKGROUND OF THE ART

Containers for infusion of tea, spices and other condiment particles are immersed into liquid such as hot water, oils and beverages, and generally utilize an enclosed screen or perforated container to eliminate the need to strain the solid particles from the liquid after infusion. Solid particles such as tea leaves are contained within the infuser vessel and are exposed to the liquid by passage of liquid through the screen or perforation of the vessel. In the case of tea and other infusions, manufactured tea bags or use of cheese cloth to wrap spices in a package perform the same function in a disposable format.

A disadvantage of these infusers is that the user of a manufactured tea bag for example has no control over the amount of tea used and therefore the strength of tea produced depends on the user regulating the time of infusion or requires the user to agitate the tea bag with a spoon or suspending string. As well, use of premanufactured tea bags prevents the user from utilising their own selected mix or from creating different mixes of tea flavours to suit their own particular taste.

To provide a more permanent reusable system, an openable vessel is often used which is immersed in liquid hanging from a chain or string. A disadvantage of such reusable, and disposable infusers including tea bags, is that the user often drops the chain or string into the hot liquid and must fish it out from the hot liquid creating an inconvenience and safety hazard.

A further disadvantage however which is of particular interest to the present invention, is the slow speed with which materials contained within an infuser actually perform the infusion process. To speed up the process, users often raise and lower a tea bag or infuser within the liquid to stir the solid particles and increase flow of liquid past the tea leaves thereby increasing the speed of infusion. Needless to say, when involved with hot liquids, splashing of the liquid is dangerous, the heat and steam escapes from the liquid, and the conventional method of raising or lowering an infuser or tea bag to speed up the process is highly undignified and unsatisfactory.

It is an object of the invention to provide a simple to use infuser that is reusable, easy to clean and which provides means to speed up or increase the potency of infusion if desired.

It is a further object of the invention to provide an infuser which can be immersed in the liquid and retrieved readily without relying on strings or chains that can be inadvertently dropped into the hot liquid and are difficult of remove without tongs or tweezers to avoid scalding injuries.

Further objects of the invention will be apparent from review of the disclosure, drawings and description of the invention below.

DISCLOSURE OF THE INVENTION

The invention provides an infuser for containing solid particles while immersed in a liquid, such as loose tea leaves in hot water, where the perforated infuser vessel includes a manually movable piston operated with a flexible wire topped with a manual grip extending upwardly from the liquid, whereby tea leaves within the vessel may be manually agitated to increase the speed and efficacy of infusion, while the manual grip remains high and dry.

The perforated infuser contains tea leaves or other solid particles therein while immersed in hot water or other liquid. The infuser is preferably a barrel shaped vessel with top and bottom portions joined at a releasable waist joint with a bayonet lock. The vessel has an internal chamber defined within top, bottom and side walls with apertures communicating between the inner chamber of the vessel and the liquid external thereto. The apertures have a maximum dimension selected to retain the solid tea leaf particles immersed in the liquid within the chamber. A piston is slidably disposed within the chamber for reciprocal axial motion between the top and bottom walls; and a shaft with a bottom end fixed to the piston and a top end with manual grip extends slidably through an opening in the top wall of the vessel, to enable the user to manually reciprocate the piston to stir the tea leaves and improve infusion. Preferably the plate is perforated also and the shaft is a flexible wire capped with a plastic manual grip knob.

Preferably the vessel is fabricated of stainless steel for easy cleaning. For the same reason, the remaining components are either stainless steel, brass or plastic. The plastic manual grip prevents overheating and use of a flexible wire for the shaft performs several functions. The wire has enough stiffness that projects upwardly from the surface of liquid and cannot be accidentally dropped into the liquid as a string or a chain can be. Further, the wire is flexible enough to be flexed and tucked under a teapot lid, a pot lid or cover such that the lid can close completely, but once removed, the manual grip springs upwardly on the flexible wire for easy removal or manual agitation of the infuser. Still further the flexible wire shaft provides sufficient stiffness for reciprocal up and down movement whereas a string or chain would merely be activated in tension and would simply buckle or kink under any compressive force.

Reciprocal up and down movement of the shaft causes the piston within the vessel to agitate and stir the floating solid particles or tea leaves within the vessel. Reciprocal movement also serves to alternately create a vacuum and internal pressure within the opposite ends of the chamber to draw adjacent liquid into the vessel and expel liquid from the vessel through the apertures.

The flexible wire used as a shaft capped with a plastic manual grip prevents accidental scalding or puncture injury. The plastic grip positioned under the lid of a tea pot or soup pot allows the lid to close completely, avoids scratching the underside of the lid and provides ready access when the lid is removed. However once the lid is removed the resilient wire springs to an erect position and can be easily removed without the danger of scalding. For this purpose as well the cone shaped plastic ferrule serves to support the wire in an erect position and avoids the risk of kinking the wire at the entry point into the vessel during use. Use of a plastic ferrule also tends to lubricate the sliding wire and prevent binding or kinking during use.

Further advantages of the invention will be apparent from the drawings and detailed description presented below.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
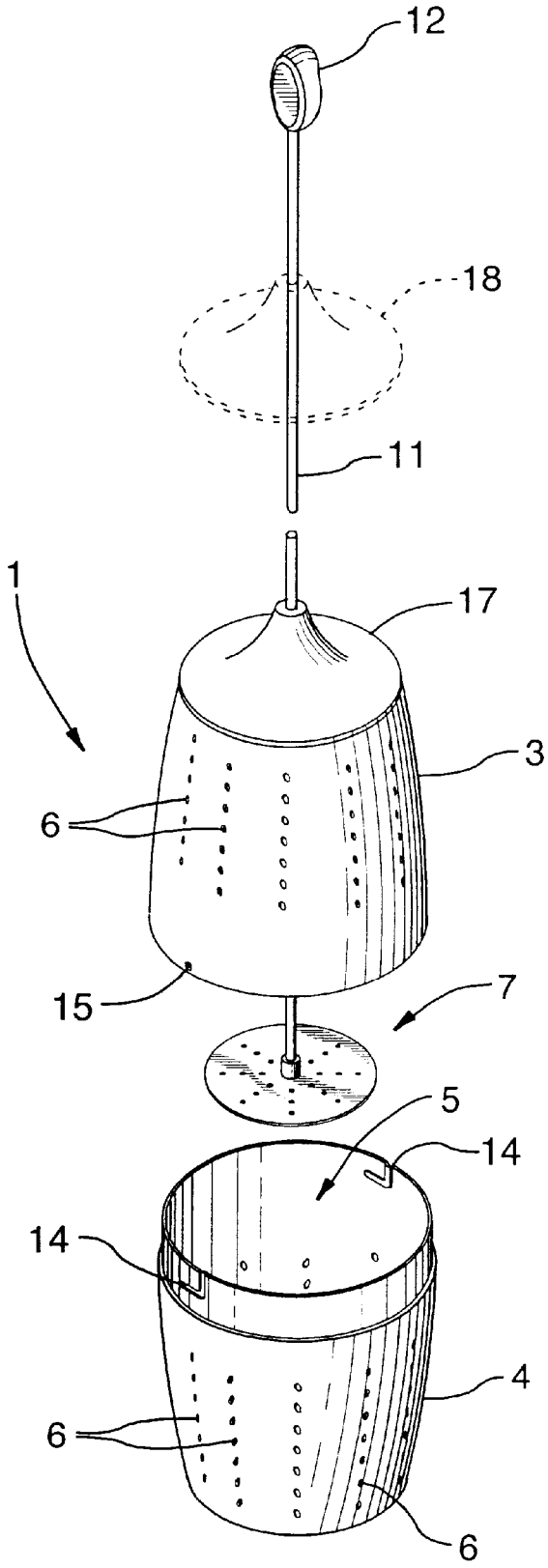
FIG. 1 is an exploded perspective view of a barrel shaped infuser vessel showing the internal piston at the bottom end of the sliding wire shaft with a manual grip at the top end.

FIG. 1 shows an exploded view of the infuser vessel 1 which is used to contain solid particles while immersed in a liquid. For example, the infuser vessel 1 can be filled with tea leaves (as in FIGS. 6 and 7) for preparing tea or with a variety of spices to provide an infusion for an oil mixture or with spices for immersion within a soup broth.

Figure 2:
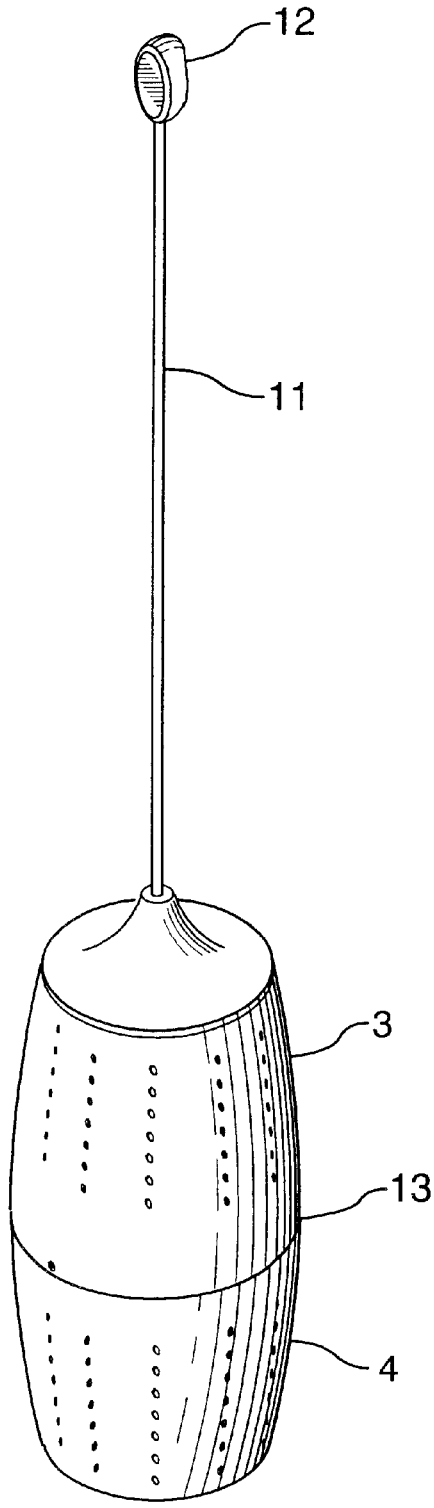
FIG. 2 is a perspective view of the assembled infuser.

As shown in FIGS. 1 and 2, the vessel top portion 3 and the vessel bottom portion 4 are joined together along a rotatably sliding lap joint 13. The cone shaped plastic ferrule 17 and plastic manual grip 12 are disposed on the wire shaft 11 that is used to manually operate the piston 7 when in the closed position as indicated with arrows in FIG. 7. By depositing solid particles in the chamber 5, the piston 7 can be used to manually agitate the particles within the chamber 7 and to force liquid in and out of the chamber 5 through apertures 6 as a vacuum and water pressure are created reciprocally by the movement of the piston 7.

Figure 4:
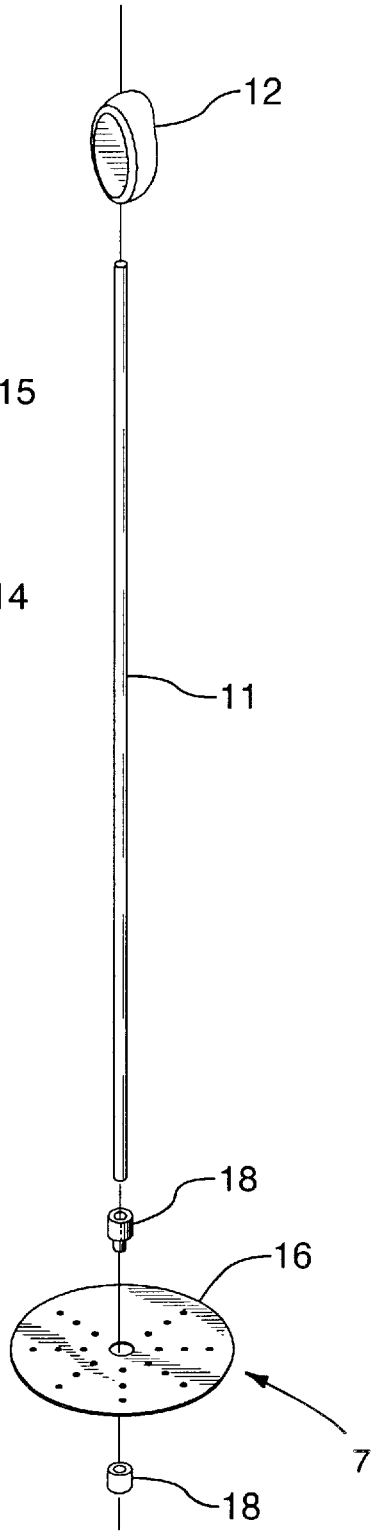
FIG. 4 is an exploded perspective view of the shaft with piston.
Figure 5:
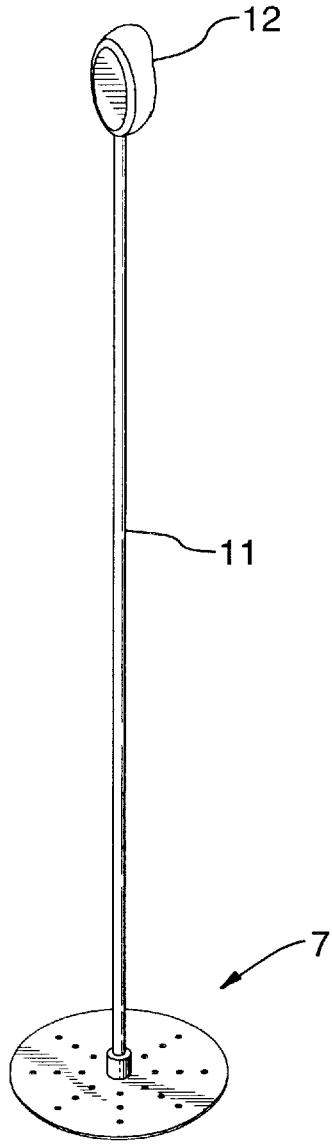
FIG. 5 is a perspective view of the shaft, manual grip and piston assembly (with ferrule and vessel not shown)

As shown in the exploded view of. FIG. 4 and assembled view of FIG. 5, the piston 7 includes a perforated flat plate 16 joined with swag lock connectors 18 to the bottom end of the wire shaft 11.

Figure 6:
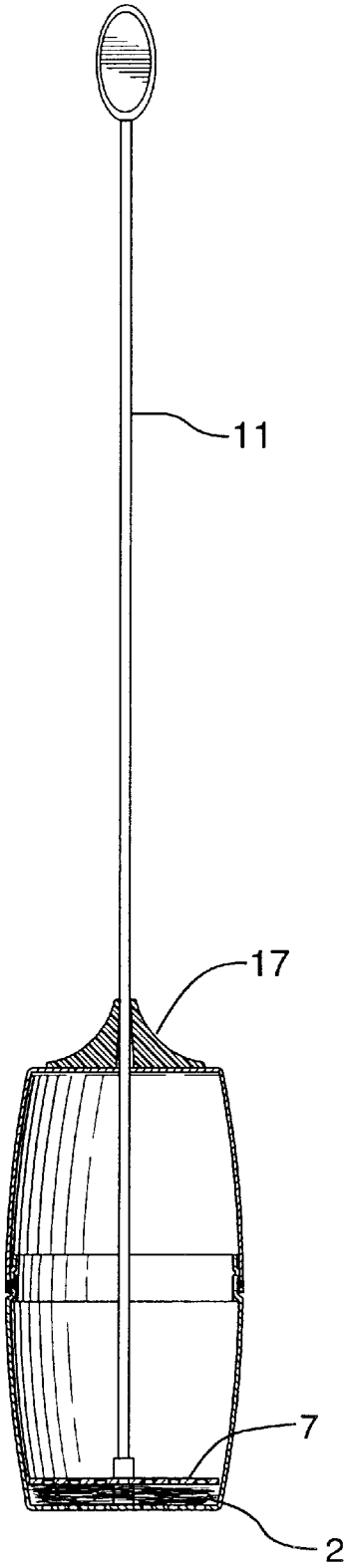
FIG. 6 is a vertical cross sectional view of an assembled infuser with tea leaves loaded into the bottom portion of the vessel beneath the piston assembly.
Figure 7:
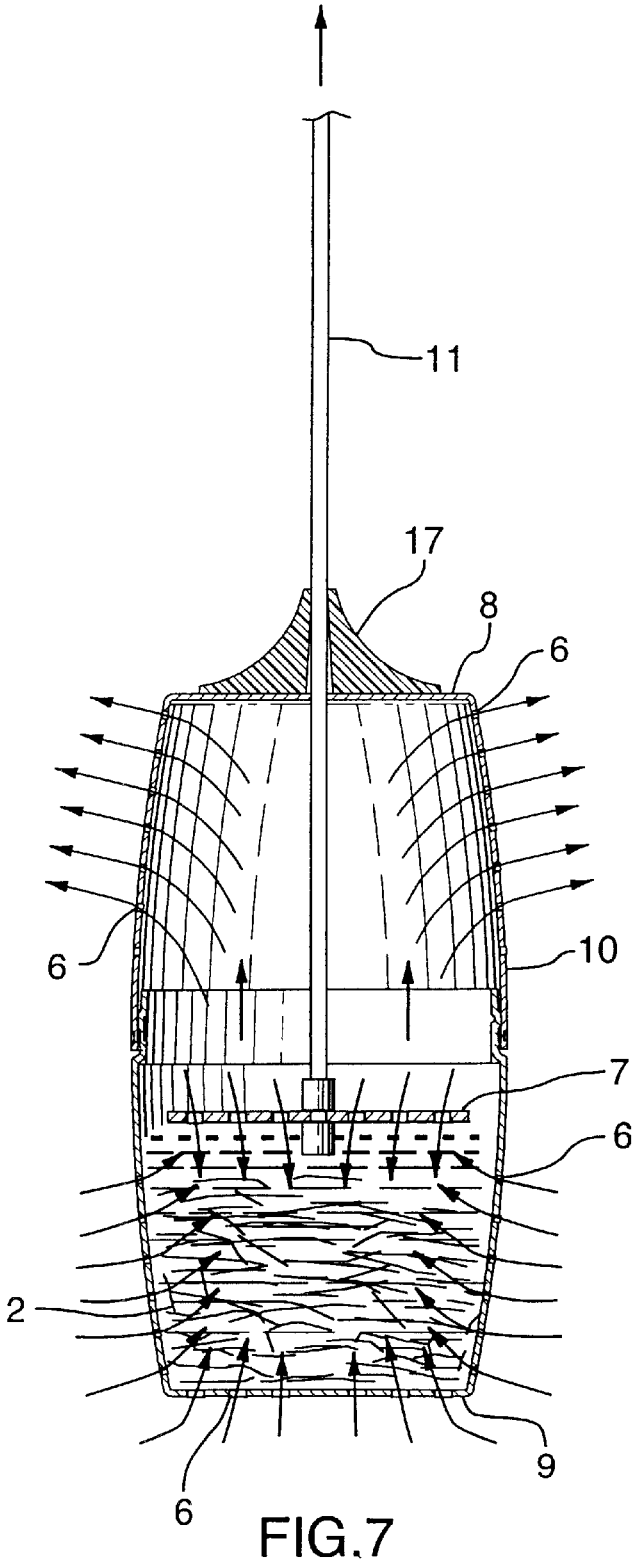
FIG. 7 is a detail vertical cross sectional view with piston while raised to intake liquid through apertures in the bottom portion of the vessel, and expel liquid from the apertures in the top portion of the vessel, (where reciprocal motion will result in alternating flow of liquid in and out of the vessel)

As indicated in FIG. 1, the ferrule 17 can freely slide upwardly on the wire shaft 11 for cleaning, but it is normally in the downward operating position as shown in FIGS. 6 and 7. The ferrule 17 is preferably made of plastic and serves to prevent binding of the wire 11 as it passes through an opening in the top wall 8 of the vessel 1. By pulling and pushing on the wire 11 during operation, there is a risk that the wire 11 may kink as it enters the opening in the top wall 8 and therefore the ferrule 17 prevents damage from local bending of the wire shaft 11. As indicated in FIG. 1 however the entire infuser vessel 1 can be opened and piston 7 and ferrule 17 moved away from the top portion 3 of the vessel to simplify cleaning with conventional dish washing equipment.

To summarize one example of the invention therefore, the infuser 1 contains solid particles such as tea leaves 2 while immersed in a liquid such as hot water. The hollow infuser vessel 1 has an internal chamber 5 that is defined within the top wall 8, bottom wall 9 and side walls 10 of the barrel shaped vessel 1. At least one wall 8, 9 or 10 and preferably all walls includes aperture 6 that communicate between the chamber 5 and liquid external within which the infuser is immersed. In order to contained the solid particles 2 immersed within the liquid in the chamber, the apertures 6 have a maximum opening dimension that is selected to strain or retain the solid particles within the internal chamber 5.

The piston 7 is slidably disposed within the chamber 5 for reciprocal axial or vertical motion (as shown in FIG. 7, for example) between the top wall 8 and the bottom wall 9. The top end of the shaft 11 includes a manual grip 12 and the bottom end is fixed with swag lock connectors 18 to the piston 7. The top end of the wire shaft 11 extends slidably through a opening in the top wall 8 of the vessel 1. As the infuser vessel 1 is immersed in liquid, the user may reciprocate the piston 7 within the chamber 5 without lifting and lowering the entire infuser.

Figure 3:
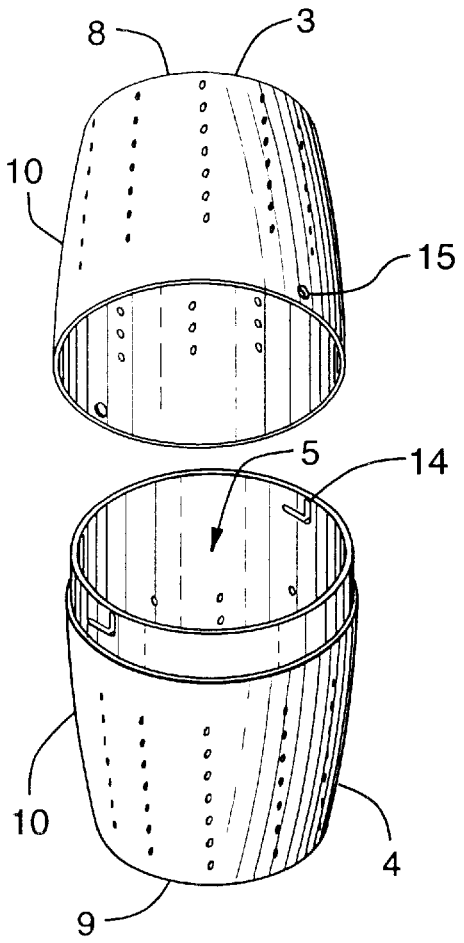
FIG. 3 is a perspective view of an opened vessel showing details of the joint on top and bottom portions of the vessel.

As shown in FIGS. 3 and 1, the vessel 1 includes a top portion 3 and a bottom portion 4 that are joined together along a releasable rotating sliding joint 13. In the embodiment shown in the invention, a simple sliding lap joint 13 is used with a bayonet lock consisting of two grooves 14 and two locking dimples 15, both of which are easily formed with conventional sheet metal stamping techniques.

The piston 7, as illustrated, can include a flat plate 16, which is perforated to enhance fluid flow as the piston 7 is reciprocated. Optionally, the piston 7 can include a brass wire screen as illustrated that is secured to the wire shaft 11 with swag lock connectors 18. As indicated in FIG. 1, the shaft 11 may include a plastic sliding ferrule 17 that is disposed on the shaft 11 between the manual grip 12 and the top wall 8 of the vessel 1 that serves to avoid kinking of the flexible wire shaft 11 as it is reciprocated through a narrow opening in the top wall 8.

Although the above description relates to a specific preferred embodiment as presently contemplated by the inventor, it will be understood that the invention in its broad aspect includes mechanical and functional equivalents of the elements described herein.

I claim:

1. An infuser for containing solid particles (2) therein while immersed in a liquid, the infuser comprising:

a vessel (1) having an internal chamber (5) defined within top (8), bottom (9) and side walls(10), at least one said wall including apertures (6) communicating between the chamber (5) and the liquid external thereto, the apertures (6) having a maximum dimension selected to retain the solid particles (2) immersed in the liquid within the chamber (5);

a piston (7) slidably disposed within the chamber (5) for reciprocal axial motion between the top (8) and bottom walls (9); and a flexible wire shaft (11) having a bottom end fixed to the piston (7) and a top end extending slidably through an opening in the top wall of the vessel, the top end having a manual grip (12).

2. An infuser according to claim 1 wherein the vessel (1) includes a top portion (3) and a bottom portion (4) joined together along a releasable joint (13).

3. An infuser according to claim 2 wherein the joint includes a bayonet lock (14, 15).

4. An infuser according to claim 2 wherein the joint comprises a sliding lap joint (13).

5. An infuser according to claim 2 wherein the vessel (1) is barrel shaped.

6. An infuser according to claim 1 wherein the piston (7) comprises a flat plate (16).

7. An infuser according to claim 6 wherein the plate (16) is perforated.

8. An infuser according to claim 1 wherein manual grip (12) comprises a plastic knob (12).

9. An infuser according to claim 1 including a ferrule (17) disposed on the shaft (11) between the manual grip (12) and the top wall (8) of the vessel (1).

* * * * *